United States Patent [19]

LeFebvre

[11] Patent Number: 4,492,615

[45] Date of Patent: Jan. 8, 1985

[54] PROCESS FOR PLATING A LONG SPAN OF METAL WITH A METAL LAYER

[75] Inventor: Jacques LeFebvre, Voiron, France

[73] Assignee: Aluminium Pechiney, Paris, France

[21] Appl. No.: 486,012

[22] Filed: Apr. 18, 1983

[30] Foreign Application Priority Data

Apr. 29, 1982 [FR] France ..... 82 07922

[51] Int. Cl.[3] ..... C25D 7/06; C25D 5/04; C25D 5/44

[52] U.S. Cl. ..... 204/28; 204/33; 204/49; 204/207

[58] Field of Search ..... 204/28, 33, 32 R, 34, 204/49, 129.75, 129.8, 206–210

[56] References Cited

U.S. PATENT DOCUMENTS 3,755,116 8/1973 Terai et al. ..... 204/129.95
3,766,043 10/1973 Herrmann et al. ..... 204/28 X
3,915,667 10/1975 Ricks ..... 204/33 X
4,097,342 6/1978 Cooke et al. ..... 204/28
4,128,459 12/1978 Bretts et al. ..... 204/28
4,169,770 10/1979 Cooke et al. ..... 204/28

FOREIGN PATENT DOCUMENTS 775769 5/1957 United Kingdom ..... 204/28

*Primary Examiner*—Howard S. Williams
*Assistant Examiner*—T. L. Williams
*Attorney, Agent, or Firm*—Oblon, Fisher, Spivak, McClelland & Maier

[57] ABSTRACT

A process for the continuous, electrolytic plating of a long span of metal with a layer of metal, having a high line speed and low period of immersion in the electrolyte, and a device therefor. The span of metal is passed through a shaving drawplate, then through a metal plating solution to which an electric voltage is applied through a fluid electric connector comprising a solution of metal chloride, a fluoride and boric acid.

The process is used to plate a metal with an adhesive metal layer, which provides both ductility to facilitate extrusion and low, non-evolving contact resistance.

15 Claims, 1 Drawing Figure

PROCESS FOR PLATING A LONG SPAN OF METAL WITH A METAL LAYER

BACKGROUND OF THE INVENTION

1. Field of the Invention

The invention relates to a process and a device for plating, continuously and at high speed, a long span of metal such as wire, tubing, round or flat metal strips with a layer of metal. More particularly, it applies to nickel plating of aluminum wire used in electrical applications.

2. Description of the Prior Art

There exist numerous conventional processes for plating metal parts with other metals in order to improve the surface properties of the metal parts such as appearance, resistance to corrosion, and contact electrical resistance. These processes are based on a variety of techniques such as deposition by metal plating, by plasma, in the vapor phase, by chemical means, by coating, by co-lamination or co-extrusion, or by electrolytic means.

Depending on the type of metal to be plated, its surface characteristics, the type of plating, the types of constraints imposed by the device for implementing the process, and the characteristics desired of the final product, all of these processes display advantages and disadvantages. The process representing the best compromise must be selected as a function of the final objectives.

In the present case, the principal objective is to provide a solution to the problem of plating aluminum or aluminum alloys with electric conductors. It has been known for a number of years that aluminum and its alloys, and, more particularly, the alloy designated as 6101 by the Aluminum Association, is similar to copper both in terms of electric resistivity and mechanical characteristics. However, its use in the form of wire is not recommended in connection systems currently used in electrical equipment, and more particularly in high-use or high-temperature applications. Under these conditions, an increase of contact resistance is observed, which may lead to overheating, which is detrimental to the durability of this type of conductor and to equipment safety. In order to benefit completely from the indisputable advantages of aluminum and to promote its universal use instead of copper in conductors, it was therefore necessary to design an economical process for providing a stable contact resistance for the wire which would be at least equal to that of copper in the long term.

Other attempts have been made to promote increased use of aluminum conductors and to dispel the prejudices of manufacturers of electrical equipment who are reluctant to use aluminum. Other manufacturers and aluminum users have attempted to develop technological improvements designed to solve this contact resistance problem. The following solutions have been proposed:

co-lamination and co-extrusion processes, the development of which has been limited due to high manufacturing costs;

electrolytic tin coating processes, which have not become widespread due to time-consuming preliminary metal preparation requiring undercoating with bronze and/or copper by immersion in cyanide baths and to the rising price of tin, which has become a strategic metal.

Therefore, a trend has emerged in recent years favoring the use of plating with nickel—a metal which is far less expensive than tin, yet which intrinsically possesses good resistance to high temperatures, while continuing to plate with electrolysis, a practice well-adapted to aluminum.

Consequently, there has emerged in this field a number of processes involving cells in which the electrolyte circulates at high speed, or which use a more or less complex surface preparation, or intermediary layers for galvanizing. All of these methods produce a relatively adhesive coating, but display one major disadvantage: relatively slow processing speeds, usually limited to a few meters per second. Moreover, these methods require the use of extremely long devices, the production of which involves significant investment costs, to obtain sufficient immersion time in the electrolytic solution.

French Pat. No. 2,012,592 teaches that it is possible to coat aluminum wire with a 3 μm layer of copper, at a line speed of 30 meters per minute, first by drawing it thorough a peripheral drawplate, then through an electrolytic bath of 3 m. in length to which an electromotive force is applied through an anode contained in this electrolytic solution with the wire acting as a pure cathode. Although the time of immersion in the electrolytic solution is only six seconds for a thickness of 3 μm, the coating is formed of copper. Therefore, the results of the present process using nickel could not be predicted, particularly with regard to adhesion and contact resistance.

In an attempt to apply this teaching to nickel plating of aluminum, without attention to the method of planing, in a 5 m long bath; difficulties were encountered, particularly in terms of the supply of electric power to the wire. All of the devices employed—wheels, rollers, friction contacts—produced electric arcs of increasing magnitude that became increasingly detrimental to the adhesion of the plating with higher line speeds, requiring a reduction of current density, and, consequently, reduction of speed to obtain a layer of plating of sufficient thickness. Indeed, the maximum speeds attainable were approximately 25 m/minute, or an immersion time of 12 seconds for a thickness of 0.5 μm, for a nickel-plated wire which did not entirely conform to established standards.

Therefore, a need continues to exist for a process by which long spans of metal, particularly those made of aluminum or aluminum alloys, may be coated with an adhesive metal layer, at a high speed with a relatively short immersion time in the electrolyte, to produce a coated metal span having a thickness and contact resistance which conforms to the various standards established in the electrical industry.

SUMMARY OF THE INVENTION

Accordingly, it is an object of this invention to provide a process for the continuous, electrolytic plating of a long span of metal with an adhesive metal layer at a high line speed.

It is also an object of this invention to provide a process for the continuous, electrolytic plating of a long span of metal with an adhesive metal layer with a very short immersion time in the electrolytic solution.

Further, it is an object of the present invention to provide a process for the continuous, electrolytic plating of a long span of metal with an adhesive metal layer having a thickness and a contact resistance which conform to the various standards established in the electrical industry.

According to the present invention, the foregoing and other objects are attained by providing a process for the continuous, electrolytic plating of a long span of metal with an adhesive metal layer which involves subjecting the span of metal to a surface preparation treatment, submerging the span of metal in a metal plating solution, and applying an electric voltage to said metal plating solution, through a fluid electric connector. The fluid electric connector comprises a solution of metal chlorides, fluorides and boric acid.

BRIEF DESCRIPTION OF THE DRAWING

Other objects, features and attendant advantages of the present invention will be more fully appreciated as the same becomes better understood from the following detailed description when considered in connection with the accompanying drawing in which like reference characters designate like or corresponding parts and wherein:

The FIGURE illustrates a device which is used to perform the process of the present invention which shows a spool 1 from which the length of metal 2 uncoils, a shaving drawplate 3, a fluid electric connector basin 4 with an electrode 5 connected to the negative pole of the power supply 6 which plunges in the solution 7, a washing compartment 8, a plating basin 9 containing the solution 10 in which the positively charged electrode 11 is immersed. At the exit of this basin, a system for rinsing 12 and for drying 13 is provided, prior to coiling the length of metal on a spool 14.

DETAILED DESCRIPTION OF THE PREFERRED EMBODIMENTS

Figure 1:
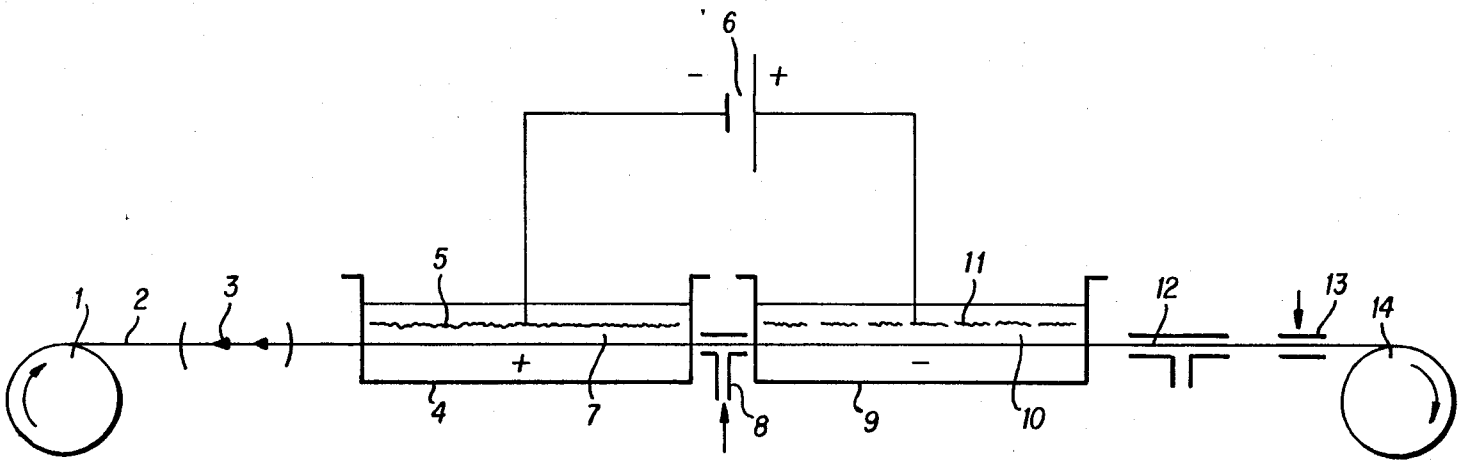

The substitution of a fluid electric connector for a mechanical system is a solution developed by the present invention. During the course of numerous tests, it was noted that, using such means, a wire of appropriate quality could be produced at a speed higher than was previously achievable, and with relatively low immersion times. Additionally, it was found that this means could even be applied to other metals and to other platings. On this basis, the object of the process, according to this invention, is to electrolytically and continuously plate at a high line speed with very short immersion time in the electrolytic solution, a long span of metal with an adhesive metal layer, wherein said span may be subjected to a surface preparation treatment, then moved through the metal plating solution to which an electric current is applied to form the plating, through a fluid electric connector.

Thus, the metal span—which may be a wire, tubing, a round or flat bar formed of aluminum, copper or other metal—may first be subjected to a conventional chemical degreasing or etching to remove surface impurities, and then is placed in a metal plating solution, preferably nickel. However, the metal plating solution can use any other metal that can be electrolytically deposited and which is selected as a function of the problem to be solved.

An electrical voltage—which may be direct or alternating—is then applied to this solution. Table I illustrates the use of voltages between 5.8 and 44.7 volts. Voltages which are greater or less than this range may be used, however, it is preferable to use an electromotive force which provides an adequate thickness of adhesive metal plating, yet which is also economical. The positive pole of the current source is connected in a conventional manner to an electrode plunged into said solution. However, in closing the circuit, the negative pole is no longer directly connected to part of the metal span in accordance with conventional practice, but through an electrode plunged into a conductive liquid through which said span passes, and which forms the fluid electric connector. In other words, the electric voltage is applied in such a manner that the positive terminal power supply is connected to the metal plating solution, or in particular, the nickel plating solution, and the negative terminal to the fluid electric connector, the passage of the current from one to the other being effected by the long span of metal, or in particular, the aluminum span.

This process obviates disadvantages due to poor mechanical contacts and thus provides a substantial improvement of current densities and, consequently, an increased line speed and reduced immersion time, since the length of contact with the electrolyte is kept at 5 m. Moreover, it was also noted that performance could be further improved by judicious selection of the composition of the liquid designed to form the fluid electric connector, and that said connector depended on the composition of the plating solution and on the metal to be processed. Indeed, it is necessary for said composition to allow for high current densities while maintaining balanced voltages among the liquids forming the connector and the plating bath.

Thus, in the case of nickel plating, it has been determined that the best results are obtained using the following electrolytic solutions:

for the fluid electric connector, a mixture of metal chlorides, fluorides and boric acid, such as, for example, the following mixture:

| | |
|---|---|
| $NiCl_2.6H_2O$ | 125 g/l |
| $H_3BO_3$ | 12.5 g/l |
| HF | 6 cc/l |

for the plating, conventional nickel plating baths may be employed, preferably having the following composition:

| | |
|---|---|
| Ni $(NH_2SO_3)_2$ (sulfamate) | 300 g/l |
| $NiCl_2.6H_2O$ | 30 g/l |
| $H_3BO_3$ | 30 g/l |

These solutions are used at temperatures appropriate for attaining equivalent resistivity.

For instance, for the compositions defined above, these temperatures are, respectively, approximately 35° and 50° C.

Under these conditions, nickel platings having a thickness of several μm at a line speed on the order of 30 m/minute with an immersion time of less than 12 seconds are obtained. This constitutes a significant improvement over the earlier technique employing a mechanical contact and wherein, for a similar speed and immersion time, the thickness of plating was less than 0.5 μm.

However, the advantages of using a special surface preparation process for the span of metal was noted. Using a rough extruded wire, a nickel plate having a good appearance and adhesiveness and a low contact resistance was obtained. The disadvantage was that the fluid electric connector became contaminated by surface impurities. Any type of conventional degreasing process for surface preparation was too time-consuming to obtain adequate action, and integrating such a step in the continuous process result in a reduced line speed.

A scalping system was then added to the electrolytic plating treatment using a fluid connector. It was noted that this new combination produced a high line speed, short immersion time, an adhesive deposit, and low, non-evolving contact resistance.

For this purpose, the span of wire was run through one or more floating drawplates, which continuously removed the peripheral part of the length of metal, to a thickness of 1 to 2/100 mm, thus eliminating the layer of oxidation and the lubricant residues.

Under these conditions, the results achieved went far beyond expectation, as the maximum speed capacity of the experimental equipment, which is 300 m/minute with thicknesses between 1 and 3 μm inclusive, had already been reached. This value appears to be limited by the electric power utilized. The quality of nickel plated wire obtained in this fashion was analyzed in accordance with applicable electrical standards and was found to be very satisfactory.

More particularly, wrapping tests for ten coils on the diameter were performed, and it was noted that the nickel plate was remarkably ductile, and was especially well-adapted to extrusion. Thus, in a first test, No. 6101 aluminum alloy wire with a diameter of 1.78 mm, was plated according to the invention with a nickel layer of 3 μm and was extruded to a diameter of 0.78 mm. It exhibited no separation or removal of the nickel plate. In a second test a No. 1350 aluminum wire with a diameter of 5.67 mm was extruded to 0.78 mm in 16 passes. The nickel plate continued to adhere while maintaining a low contact resistance after each pass.

In order to implement this process, an extremely simple, short experimental device has been designed, successively comprising, in the direction along which the length of metal moves, a fluid electric connector formed of a basin of only 5 m in length, containing an electrolyte in which an electrode with a negative charge is plunged, a plating basin of the same length containing the plating solution, in which an electrode with a positive charge is plunged, and wherein the two basins may be separated by a rinsing system.

This device is represented in the FIGURE which shows a spool 1 from which the length of metal 2 uncoils, a shaving drawplate 3, a fluid electric connector basin 4 with an electrode 5 connected to the negative pole of the power supply 6 which plunges in the solution 7, a washing compartment 8, a plating basin 9 containing the solution 10 in which the positively charged electrode 11 is immersed. At the exit of this basin, a system for rinsing 12 and for drying 13 is provied, prior to coiling the length of metal on a spool 14.

The present invention will be further illustrated by certain examples and references which are provided for purposes of illustration only and are not intended to limit the present invention.

A series of 18 tests, with varying processing conditions, were performed on a No. 6101 aluminum alloy wire:

Tests 1–5:

A No. 6101 aluminum alloy wire having a diameter of 1.78 mm was given no surface treatment prior to processing and was plated according to the operating parameters set forth in Table I. The alloy wire used in Tests 1–5 had the following mechanical characteristics:

| | |
|---|---|
| Resistance at stretching of 0.2% | 154 MPa |
| Maximum resistance | 173 MPa |
| Stretching to breaking point | 5.3% |

Tests 6–11:

A No. 6101 aluminum alloy wire having a diameter of 1.78 mm was given a shaving treatment prior to processing and was plated according to the operating parameters set forth in Table I, the alloy wire used in Tests 6–11 had the same mechanical characteristics as in Tests 1–5.

Tests 12–18:

A No. 6101 aluminum alloy wire having a diameter of 1.78 mm was given a shaving treatment prior to processing and was plated according to the operating parameters set forth in Table I. The alloy wire used in Tests 12–18 had the following mechanical characteristics.

| | |
|---|---|
| Resistance of stretching of 0.2% | 215 MPa |
| Maximum resistance | 226 MPa |
| Stretching to breaking point | 3.4% |

With respect to the various operating parameters and results listed in Table I, the following clarifications are made. The temperature of basin I refers to the fluid connector and basin II refers to the plating solution. The electrical conditions refer to the voltage (in volts) of power applied to the two electrodes and $A/dm^2$ refers to the current density flowing through the system. The line speed of the wire is given as m/min, and the best result obtained with the processed wire at a given line speed was recorded. The contact resistance in mΩ was determined by the cross-wire method, on which a mass of 1 kg was placed. The thickness of the nickel plating was recorded in μm, and was obtained by determining the weight of nickel collected by dissolving the plating in nitric acid.

Finally, observations on the wire's resistance to repeated electrical use was controlled by subjecting it to up to 200 thermal cycles at approximately 30 A. During each of these cycles, in various connector assemblies, the processed wire is heated to 120° C. by the excessive current which passes through it, then cooled at ambient temperature. The resistance of the processed wire is considered to be good if the resistance of contact, R, and the temperature of the connection do not increase.

The results illustrated in Table I clearly demonstrate the efficiency of the claimed process and show a surprising increase in the effectiveness of electrolysis as a function of speed. In this regard, tests 17 and 18 are instructive, wherein for line speeds of 200 and 300 m/mn, respectively, the plating thicknesses obtained are almost equivalent.

TABLE I

| Test No. | Surf. prep. | Temperature Bath I | Temperature Bath II | Electrical conditions Volt. (volts) | Electrical conditions Dens. (A/dm²) | speed m/mn | Adhesion | contact R (mΩ) | thickness Ni (μm) | Obs. on elec. aging |
|---|---|---|---|---|---|---|---|---|---|---|
| 1 | none | 35° C. | 50° C. | 5.8 | 21 | 15 | good | 0.58 | 1.60 | |
| 2 | " | " | " | 5.8 | 21 | 30 | good | 1.42 | 0.84 | |
| 3 | " | " | " | 9.2 | 35 | 30 | good | 1.03 | 1.53 | |
| 4 | " | " | " | 9.2 | 35 | 15 | good | 0.60 | 2.37 | |
| 5 | " | " | " | 8 | 28 | 15 | good | 1.47 | 2.89 | |
| 6 | shaving 01.76 1.75 mm | " | " | 9.6 | 35 | 30 | good | 0.55 | 1.28 | |
| 7 | shaving 01.76 1.75 mm | " | " | 18.1 | 70 | 30 | good | 0.62 | 2.89 | |
| 8 | shaving 01.76 1.75 mm | " | " | 35.5 | 140 | 60 | good | 0.55 | 3.01 | gd. to 200 cycles |
| 9 | shaving 01.76 1.75 mm | " | " | 44.7 | 170 | 90 | good | 0.57 | 2.09 | |
| 10 | shaving 01.76 1.75 mm | " | " | 44 | 160 | 120 | good | 0.84 | 1.53 | |
| 11 | shaving 01.76 1.75 mm | " | " | 44 | 160 | 190 | good | 1.03 | 0.96 | |
| 12 | shaving 01.76 1.75 mm | " | " | | 140 | 60 | good | 0.64 | 2.89 | |
| 13 | shaving 01.76 1.75 mm | " | " | | 160 | 90 | good | 0.72 | 2.09 | |
| 14 | shaving 01.76 1.75 mm | " | " | | 160 | 120 | good | 0.61 | 1.53 | |
| 15 | shaving 01.76 1.75 mm | " | " | | 160 | 190 | good | 0.78 | 1.08 | |
| 16 | shaving 01.76 1.75 mm | 40° C. | 65° C. | 41.5 | 175 | 120 | good | 0.76 | 1.61 | |
| 17 | shaving 01.76 1.75 mm | " | " | 41.5 | 170 | 200 | good | 1.01 | 1.16 | |
| 18 | shaving 01.76 1.75 mm | " | " | 41.5 | 175 | 300 | good | 1.01 | 1.12 | gd. to 200 cycles |

Table II below shows, for a No. 6101 aluminum alloy wire with a diameter of 1.75 mm, corresponding to test No. 8 in Table 1, the results of measurements of initial contact resistance (R0) and after 200 R200 cycles performed on plate terminals during 8 tests identified as 1 through 8. It also provides contact temperature measurements after 1 θ1 cycle and after 200 θ0200 cycles, and compares these to the reference contact temperature, θ'. These tests were performed under two different torque loads: 0.33 and 0.5 mN, whch have practically not evolved during the cycles, at an ambient temperature near 20° C. and at an amperage of 31.5 A.

Table III on the following page shows the results of the same tests performed on a copper wire having a section of 1.5 mm².

TABLE II

| Tests performed on a No. 6101 aluminum alloy wire, plated at 60 m/minute | | | | | | | | | | |
|---|---|---|---|---|---|---|---|---|---|---|
| | Torque Load: 0.33 mN | | | | | Torque Load: 0.5 mN | | | | |
| Test No. | R in μΩ @ 20° C. | | | θ ambient 20° C. I = 31.5A | | R in μΩ @ 20° C. | | | θ ambient 20° C. I = 31.5A | |
| reference | | $R_0$ | $R_{200}$ | $\theta_{100}$ | $\theta_{200}$ | | $R_0$ | $R_{200}$ | $\theta_1$ | $\theta_{200}$ |
| | R' | 153 | 153 | θ'' 125 | 120 | R' | 153 | 153 | θ'' 125 | 120 |
| 1 | | 152 | 155 | 64 | 66 | | 150 | 155 | 71 | 71 |
| 2 | | 150 | 155 | 69 | 70 | | 149 | 153 | 71 | 70 |
| 3 | | 150 | 152 | 72 | 72 | | 150 | 155 | 72 | 73 |
| 4 | | 142 | 145 | 65 | 67 | | 150 | 155 | 71 | 68 |
| 5 | | 152 | 155 | 71 | 70 | | 153 | 158 | 70 | 70 |
| 6 | | 152 | 155 | 69 | 68 | | 148 | 153 | 71 | 71 |
| 7 | | 150 | 155 | 70 | 69 | | 150 | 155 | 68 | 60 |
| 8 | | 150 | 155 | 70 | 70 | | 148 | 153 | 70 | 68 |

TABLE III

| Tests performed on a copper wire | | | | | | | | | | | |
|---|---|---|---|---|---|---|---|---|---|---|---|
| | Torque load: 0.33 mN | | | | | | Torque load: 0.5 mN | | | | |
| | R in μΩ @ 20° C. | | | θ ambient 20° C. I = 31.5A | | | R in μΩ @ 20° C. | | | θ ambient 20° C. I = 31.5A | |
| Test No. | | $R_0$ | $R_{200}$ | $\theta_1$ | $\theta_{200}$ | Test No. | | $R_0$ | $R_{200}$ | $\theta_1$ | $\theta_{200}$ |
| Ref. | R' | 142 | 142 | θ' 137 | 140 | | R' | 142 | 142 | θ' 137 | 140 |
| 1 | | 148 | 148 | 75 | 74 | 2 | | 153 | 148 | 77 | 75 |
| 3 | | 160 | 160 | 78 | 79 | 6 | | 148 | 150 | 78 | 77 |
| 4 | | 160 | 160 | 80 | 80 | 7 | | 135 | 145 | 74 | 75 |
| 5 | | 160 | 163 | 78 | 76 | 8 | | 153 | 150 | 74 | 77 |

It is apparent that the aluminum alloy wire, plated at 60 m/mn, performs better than the copper wire having an equivalent linear resistance.

Table IV reproduces the tests shown in Table II, but is based on a wire plated at a line speed of 300 m/minute.

Comparable results can be observed.

TABLE IV

| Tests performed on a No. 6101 aluminum alloy wire, plated at 300 m/minute | | | | | | | | | | |
|---|---|---|---|---|---|---|---|---|---|---|
| | Torque Load: 0.33 mN | | | | | Torque Load: 0.5 mN | | | | |
| Test No. | R in μΩ @ 20° C. | | | θ ambient 20° C. I = 31.5A | | R in μΩ @ 20° C. | | | θ ambient 20° C. I = 31.5A | |
| reference | | $R_0$ | $R_{200}$ | $\theta_1$ | $\theta_{200}$ | | $R_0$ | $R_{200}$ | $\theta_1$ | $\theta_{200}$ |
| | R' | 145 | 145.5 | θ'' 124 | 124 | R' | 145 | 145.5 | θ' 124 | 124 |
| 1 | | 149 | 147 | 67 | 66 | | 146 | 145 | 67 | 67 |
| 2 | | 146.5 | 145.5 | 61 | 60 | | 152 | 159.5 | 64 | 66 |
| 3 | | 143.5 | 142.5 | 66 | 62 | | 153.5 | 152 | 68 | 66 |
| 4 | | 147 | 146.5 | 65 | 63 | | 148.5 | 147 | 68 | 65 |
| 5 | | 148.5 | 146.5 | 69 | 67 | | 152.5 | 146 | 67 | 65 |
| 6 | | 157.5 | 155 | 72 | 69 | | 145.5 | 143.5 | 69 | 66 |
| 7 | | 148 | 146 | 67 | 64 | | 146 | 145 | 64 | 61 |
| 8 | | 137 | 134.5 | 67 | 65 | | 147.5 | 146.5 | 68 | 65 |

This invention is applicable to all situations requiring the plating of a long span of metal with an adhesive layer of metal, diaplaying both ductility to facilitate the extrusion process and a low, non-evolving contact resistance.

It is more particularly adapted to nickel plating of aluminum or aluminum alloy electric conductors to the diameter of application.

This is the case of wire for home or industrial use, the diameters of which most frequently range from 1.5 to 3 mm.

However, because the wire nickel-plated by the process is well-adapted to extrusion, nickel plating can be performed on wire of stock diameters, that is, diameters larger than the diameter of application, which are subsequently reduced. The scope of application of the process can therefore be expanded to other areas, such as to fine wires for telephone wires, flexible cables and coil wires.

Obviously, many modifications and variations of the present invention are possible in light of the above teachings. It is therefore to be understood that within the scope of the appended claims, the invention may be practiced otherwise than as specifically described.

What is claimed as new and desired to be secured by Letters Patent of the United States is:

1. A process for the continuous electrolytic plating of a long span of metal with an adhesive nickel layer, having a high line speed and low period of immersion in the electrolyte which comprises:

(a) submerging a long span of metal in a nickel plating solution, and (b) applying an electric voltage to the nickel plating solution having said long span of metal submerged therein in such a manner that the positive terminal power supply is connected to said nickel plating solution and the negative terminal to a fluid electric connector, the passage of the current from one to the other being effected by the long span of metal, wherein said fluid electric connector comprises a solution of a nickel chloride, a fluoride and boric acid.

2. The process of claim 1 which further comprises subjecting the span of metal to a surface preparation treatment prior to submerging the span of metal in the solution of the fluid electric connector.

3. The process as claimed in claim 2, wherein the surface preparation treatment comprises passing the span of metal through at least one scalping system.

4. The process as claimed in claim 3, wherein said scalping system comprises at least one shaving drawplate.

5. The process as claimed in claim 1, wherein the span of metal comprises a continuous wire.

6. The process as claimed in claim 1, wherein the span of metal is used in electrical applications.

7. The process as claimed in claim 1, wherein the fluid electric connector comprises a solution of nickel chloride, hydrofluoric acid, and boric acid.

8. The process as claimed in claim 1 wherein said nickel plating solution comprises nickel sulfamate, nickel chloride and boric acid.

9. A process for the continuous electrolytic plating of a long span of aluminum, or an aluminum alloy, with an adhesive nickel layer, having a high line speed and low period of immersion in the electrolyte, which comprises:

(a) submerging a long span of aluminum or an aluminum alloy in a nickel plating solution, and (b) applying an electric voltage to the nickel plating solution having said long span of aluminum or aluminum alloy submerged therein in such a manner that the positive terminal power supply is connected to said nickel plating solution and the negative terminal to a fluid electric connector, the passage of the current from one to the other being effected by the long span of aluminum or aluminum alloy, wherein said fluid electric connector comprises a solution of a nickel chloride, a fluoride and boric acid.

10. The process of claim 9 which further comprises subjecting the span of aluminum or aluminum alloy to a surface preparation treatment prior to submerging the span of aluminum or aluminum alloy in the solution of the fluid electric connector.

11. The process as claimed in claim 10, wherein the surface preparation treatment comprises passing the span of aluminum or aluminum alloy through at least one scalping system.

12. The process as claimed in claim 11, wherein said scalping system comprises at least one shaving drawplate.

13. The process as claimed in claim 9, wherein the span of aluminum or aluminum alloy comprises a continuous wire.

14. The process as claimed in claim 9, wherein the span of aluminum or aluminum alloy is used in electrical applications.

15. The process as claimed in claim 9, wherein said nickel plating solution comprises nickel sulfamate, nickel chloride and boric acid.

* * * * *